US008167155B2

(12) United States Patent
Hsieh

(10) Patent No.: US 8,167,155 B2
(45) Date of Patent: May 1, 2012

(54) BEVERAGE MIXING DEVICE WITH TWO MIXED BEVERAGES

(75) Inventor: Fu-Hsin Hsieh, Nantou (TW)

(73) Assignee: Strong Energy Biotechnical Development Co., Ltd., Nantou, Nantou County (TW)

( * ) Notice: Subject to any disclaimer, the term of this patent is extended or adjusted under 35 U.S.C. 154(b) by 470 days.

(21) Appl. No.: 12/506,502

(22) Filed: Jul. 21, 2009

(65) Prior Publication Data

US 2011/0019499 A1 Jan. 27, 2011

(51) Int. Cl.
*B65D 1/04* (2006.01)
*B65D 25/08* (2006.01)
*B01F 13/00* (2006.01)

(52) U.S. Cl. ..... 215/6; 215/DIG. 8; 206/222; 366/130

(58) Field of Classification Search ..... 206/222; 215/6, 12.1, DIG. 8; 366/130
See application file for complete search history.

(56) References Cited

U.S. PATENT DOCUMENTS

| | | | | | |
|---|---|---|---|---|---|
| 3,603,469 | A * | 9/1971 | Magni | 206/222 |
| 3,613,955 | A * | 10/1971 | Wetherell, Jr. | 215/DIG. 8 |
| 3,840,136 | A * | 10/1974 | Lanfranconi et al. | 215/6 |
| 3,870,147 | A * | 3/1975 | Orth | 206/222 |
| 4,195,731 | A * | 4/1980 | Cavazza | 206/222 |
| 5,029,718 | A * | 7/1991 | Rizzardi | 206/222 |
| 5,038,951 | A * | 8/1991 | Rizzardi | 206/222 |
| 5,391,351 | A * | 2/1995 | Kaufman | 206/222 |
| 6,148,996 | A * | 11/2000 | Morini | 215/DIG. 8 |
| 7,210,575 | B2 * | 5/2007 | Oswald | 206/222 |
| 7,337,921 | B2 * | 3/2008 | Ma | 220/529 |

* cited by examiner

*Primary Examiner* — Tony G Soohoo
(74) *Attorney, Agent, or Firm* — Alan Kamrath; Kamrath IP Lawfirm, PA

(57) ABSTRACT

A beverage mixing device includes a primary container, a secondary container mounted in the primary container, a diaphragm removably mounted on the secondary container to seal the lower end of the secondary container, a sliding member movably mounted in the secondary container and having a lower end provided with a cutting blade that is movable to penetrate the diaphragm to connect the secondary container to the primary container and an upper end provided with a helical driven portion, and a top cap removably mounted on the primary container and provided with a helical drive portion abutting the helical driven portion of the sliding member to push the sliding member toward the diaphragm by rotation of the top cap relative to the sliding member.

18 Claims, 13 Drawing Sheets

BEVERAGE MIXING DEVICE WITH TWO MIXED BEVERAGES

BACKGROUND OF THE INVENTION

1. Field of the Invention

The present invention relates to a mixing device and, more particularly, to a beverage mixing device with two mixed beverages.

2. Description of the Related Art

A conventional container includes a container body to receive a beverage, and a top cap removably mounted on an open upper end of the container body to seal the container body so as to prevent the beverage from flowing or leaking from the container body. However, the conventional container can receive a single beverage only and cannot be used to receive two beverages individually, thereby limiting the versatility of the conventional container.

BRIEF SUMMARY OF THE INVENTION

The primary objective of the present invention is to provide a beverage mixing device that is operated easily and conveniently.

Another objective of the present invention is to provide a beverage mixing device, wherein the top cap, the secondary container and the sliding member are modularized and assembled previously so as to decrease the cost of fabrication of the beverage mixing device.

A further objective of the present invention is to provide a beverage mixing device, wherein the combination of the top cap, the secondary container and the sliding member can be directly mounted on the primary container easily and quickly to facilitate assembly of the beverage mixing device.

A further objective of the present invention is to provide a beverage mixing device, wherein a user only needs to rotate the top cap in the counterclockwise direction to remove the top cap from the primary container and to break the diaphragm so as to mix the first beverage and the second beverage simultaneously, thereby facilitating the user operating the beverage mixing device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
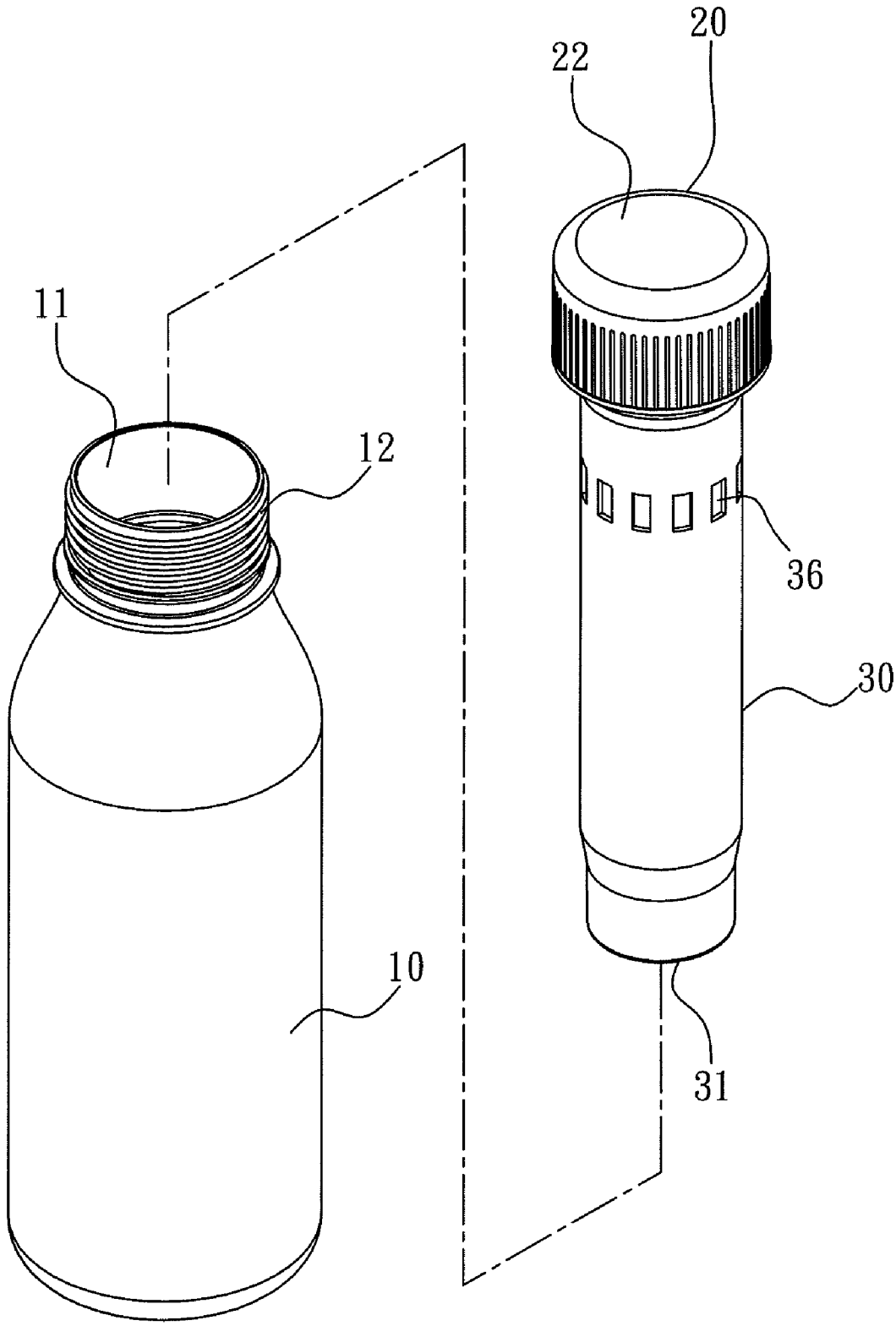
FIG. 1 is a partially exploded perspective view of a beverage mixing device in accordance with the preferred embodiment of the present invention.

Referring to the drawings and initially to FIGS. 1-6, a beverage mixing device in accordance with the preferred embodiment of the present invention comprises a primary container 10, a secondary container 30 mounted in the primary container 10, a diaphragm 31 removably mounted on a lower end of the secondary container 30 to seal the lower end of the secondary container 30 and located between the secondary container 30 and the primary container 10, a sliding member 40 movably mounted in the secondary container 30 and having a lower end provided with a cutting blade 41 that is movable relative to the secondary container 30 to penetrate the diaphragm 31 so as to connect the secondary container 30 to the primary container 10 and an upper end provided with a helical driven portion 44, and a top cap 20 removably mounted on the primary container 10 and having an inner portion provided with a helical drive portion 24 abutting the helical driven portion 44 of the sliding member 40 to push the helical driven portion 44 of the sliding member 40 toward the diaphragm 31 by rotation of the top cap 20 relative to the sliding member 40.

The primary container 10 contains a first beverage and has an inner portion provided with a compartment 13 to receive the first beverage. The primary container 10 has an upper end provided with a reduced mouth 11 connected to the compartment 13. The mouth 11 of the primary container 10 has an outer wall provided with an outer thread 12.

The secondary container 30 contains a second beverage that is mixed with the first beverage of the primary container 10 when the diaphragm 31 is removed from the lower end of the secondary container 30. The secondary container 30 is inserted through the mouth 11 of the primary container 10 and is positioned in the primary container 10. The secondary container 30 has a tubular shape and has an inner portion provided with a receiving chamber 33 to receive the second beverage. The receiving chamber 33 of the secondary container 30 is connected to the compartment 13 of the primary container 10 when the diaphragm 31 is removed from the lower end of the secondary container 30. The secondary container 30 has an inner wall provided with a plurality of axially extending limit rails 37 and an outer wall provided with an outer threaded portion 34 and two sealing rings 35. The outer threaded portion 34 of the secondary container 30 is located at an upper end of the secondary container 30. The sealing rings 35 of the secondary container 30 is closely fit in the mouth 11 of the primary container 10. The secondary container 30 has a peripheral wall provided with a plurality of conducting holes 36 each connected to the receiving chamber 33.

The beverage mixing device further comprises an upper O-ring 45 biased between the sliding member 40 and the secondary container 30 and located above the conducting holes 36 of the secondary container 30 to seal the conducting holes 36 of the secondary container 30, and a lower O-ring 46 biased between the sliding member 40 and the secondary container 30 and located under the conducting holes 36 of the secondary container 30 to seal the conducting holes 36 of the secondary container 30.

The diaphragm 31 is located at a bottom of the receiving chamber 33 of the secondary container 30 and has a peripheral wall provided with an annular tapered breakable portion 32 connected with the lower end of the secondary container 30.

Figure 9:
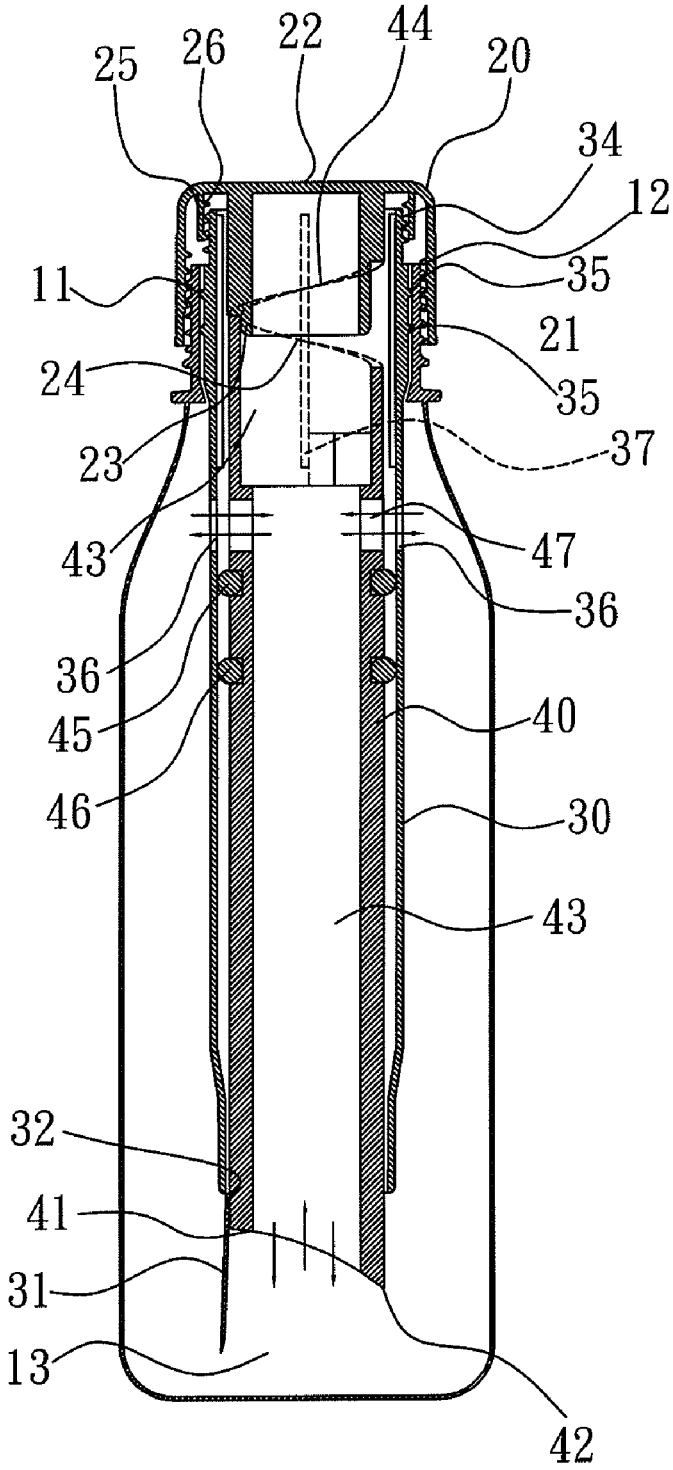
FIG. 9 is a schematic operational view of the beverage mixing device as shown in FIG. 7.
Figure 10:
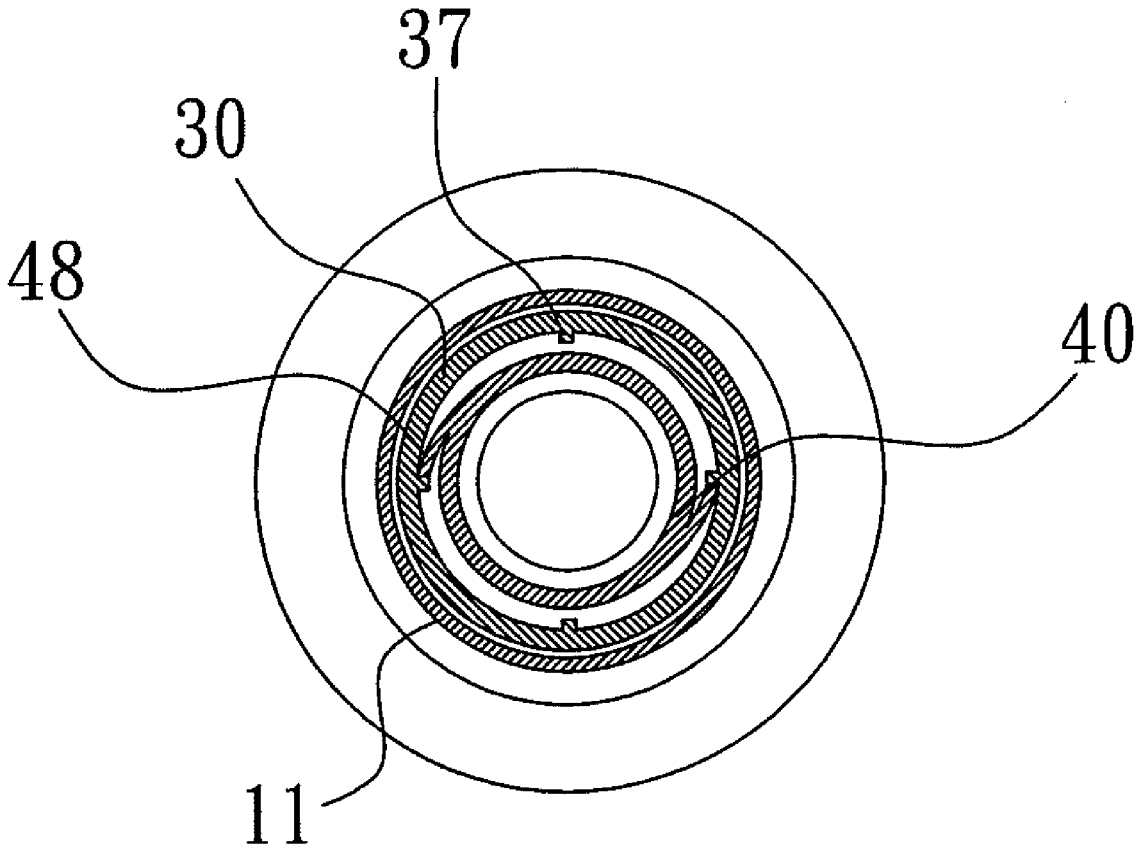
FIG. 10 is a top cross-sectional view of the beverage mixing device as shown in FIG. 9.
Figure 11:
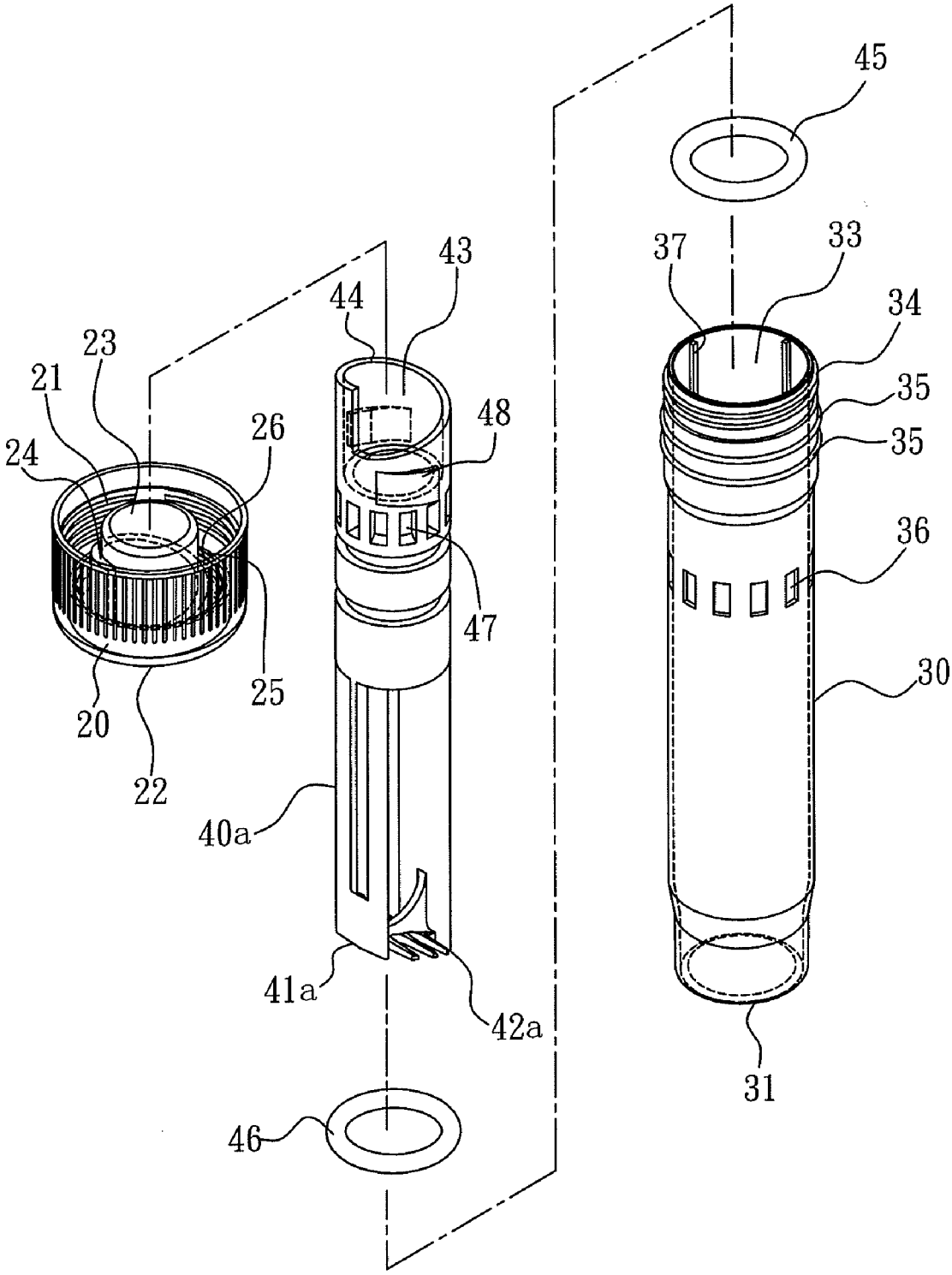
FIG. 11 is a partially exploded perspective view of a beverage mixing device in accordance with another preferred embodiment of the present invention.

The sliding member 40 has a tubular shape and has an inner portion provided with a receiving space 43 connected to the receiving chamber 33 of the secondary container 30 to receive the second beverage. The receiving space 43 of the sliding member 40 is connected to the compartment 13 of the primary container 10 when the diaphragm 31 is removed from the lower end of the secondary container 30. The sliding member 40 has a peripheral wall provided with a plurality of connecting holes 47 connected to the receiving space 43 and located above the upper O-ring 45. The connecting holes 47 of the sliding member 40 are aligned with and connected to the conducting holes 36 of the secondary container 30 when the cutting blade 41 of the sliding member 40 is moved to penetrate and break the diaphragm 31 as shown in FIG. 9. The sliding member 40 has an outer wall provided with a plurality of limit blocks 48 each abutting a respective one of the limit rails 37 of the secondary container 30 so that the sliding member 40 is limited to move axially relative to the secondary container 30 when the helical driven portion 44 of the sliding member 40 is pressed by the helical drive portion 24 of the top cap 20. In addition, the limit blocks 48 of the sliding member 40 are limited by the limit rails 37 of the secondary container 30 so that when the top cap 20 is rotated, the sliding member 40 will not driven by the top cap 20 to rotate relative to the secondary container 30. The cutting blade 41 of the sliding member 40 is located above the diaphragm 31. The cutting blade 41 of the sliding member 40 has a tapered shape and has a bottom provided with a protruding pointed portion 42 that is movable to abut the breakable portion 32 of the secondary container 30.

The top cap 20 has an inner wall provided with an inner thread 21 screwed onto the outer thread 12 of the primary container 10 to lock the top cap 20 onto the primary container 10. The top cap 20 has a top provided with a covering plate 22 to seal the mouth 11 of the primary container 10. The top cap 20 has a central portion provided with a hollow plug 23 insert into an upper end of the receiving space 43 of the sliding member 40. The helical drive portion 24 of the top cap 20 surrounds a periphery of the plug 23. The helical drive portion 24 of the top cap 20 is co-axial with and has a rotation direction (or threading direction) opposite to that of the inner thread 21. The top cap 20 is provided with a mounting sleeve 25 mounted on the secondary container 30. The mounting sleeve 25 of the top cap 20 is co-axial with and located between the helical drive portion 24 and the inner thread 21. The mounting sleeve 25 of the top cap 20 has an inner wall provided with an inner threaded portion 26 screwed onto the outer threaded portion 34 of the secondary container 30. The inner threaded portion 26 and the inner thread 21 of the top cap 20 have the same thread pitch and the same rotation direction (or threading direction).

Figure 2:
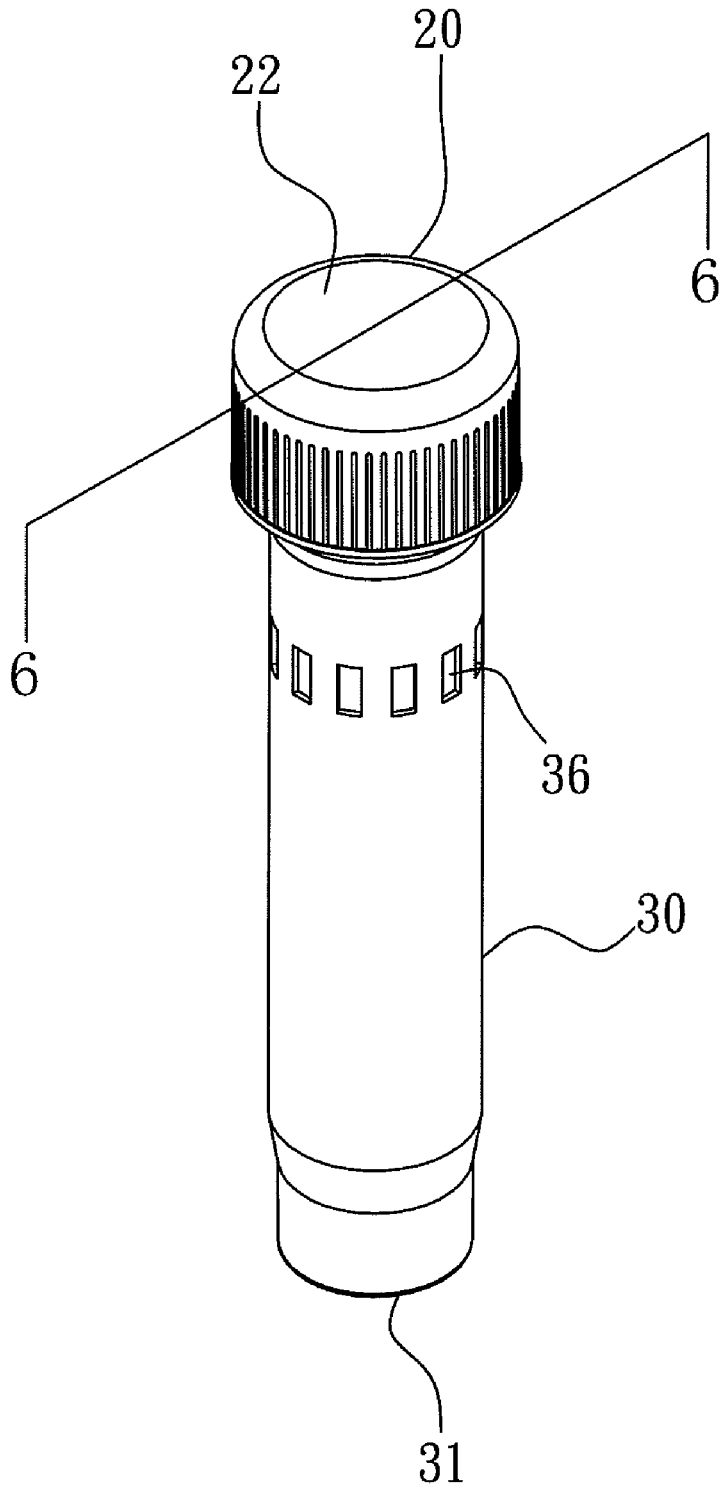
FIG. 2 is a partially perspective view of the beverage mixing device as shown in FIG. 1.
Figure 3:
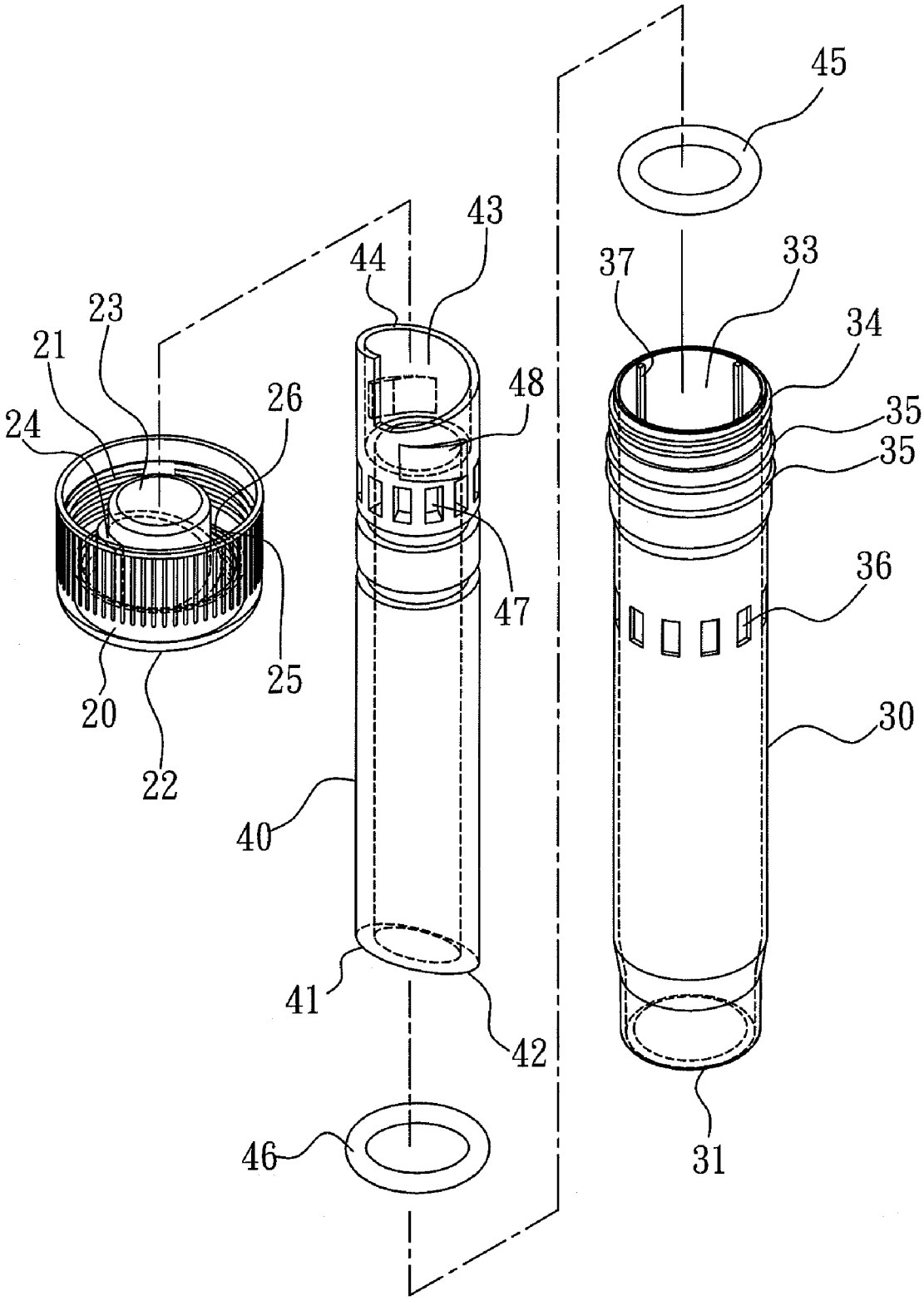
FIG. 3 is an exploded perspective view of the beverage mixing device as shown in FIG. 2.
Figure 4:
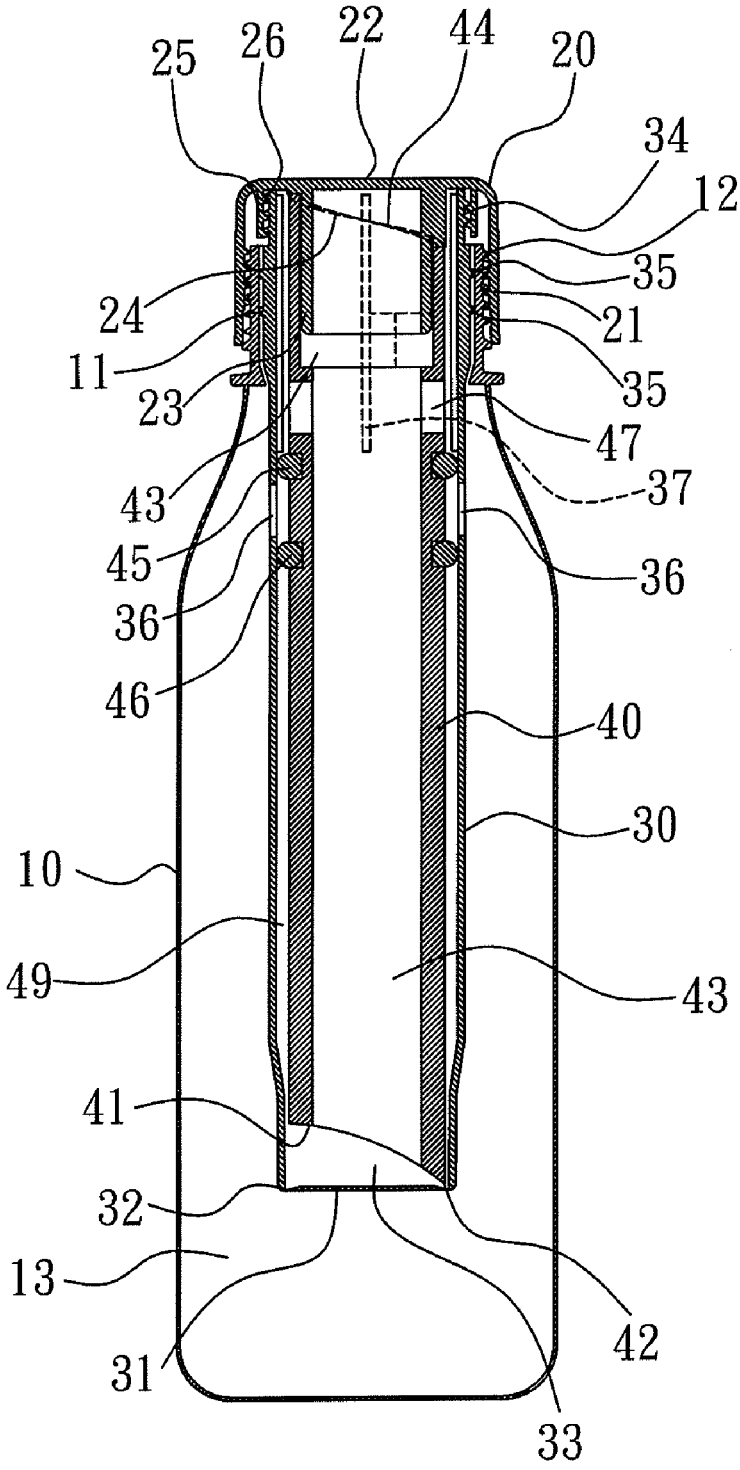
FIG. 4 is a front cross-sectional assembly view of the beverage mixing device as shown in FIG. 1.
Figure 5:
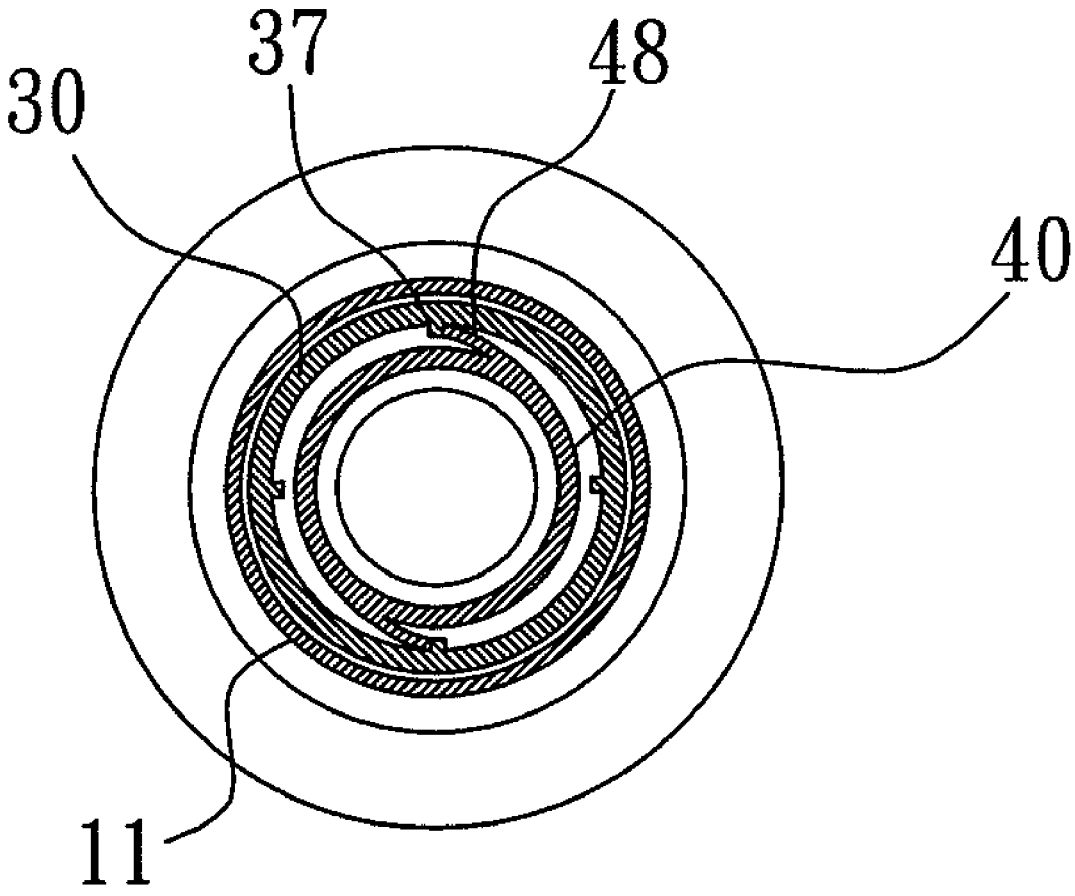
FIG. 5 is a top cross-sectional view of the beverage mixing device as shown in FIG. 4.
Figure 6:
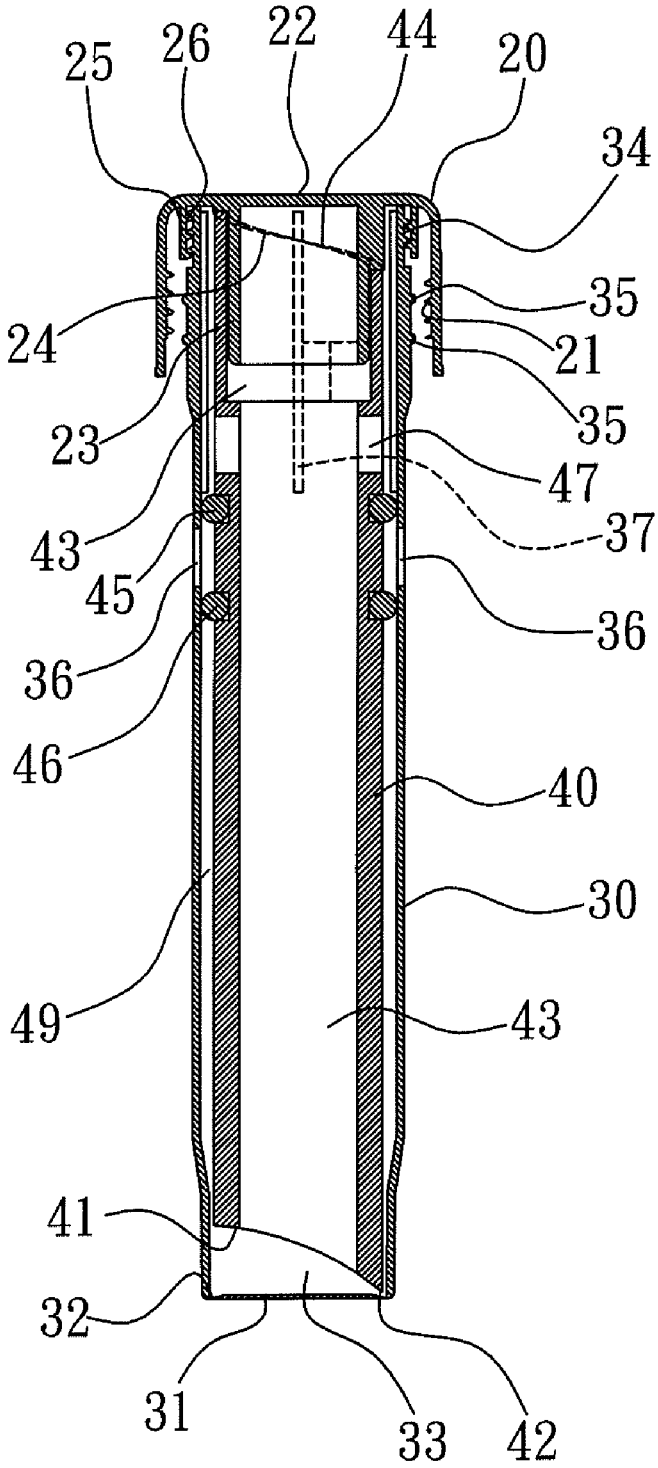
FIG. 6 is a front cross-sectional view of the beverage mixing device taken along line 6-6 as shown in FIG. 2.
Figure 7:
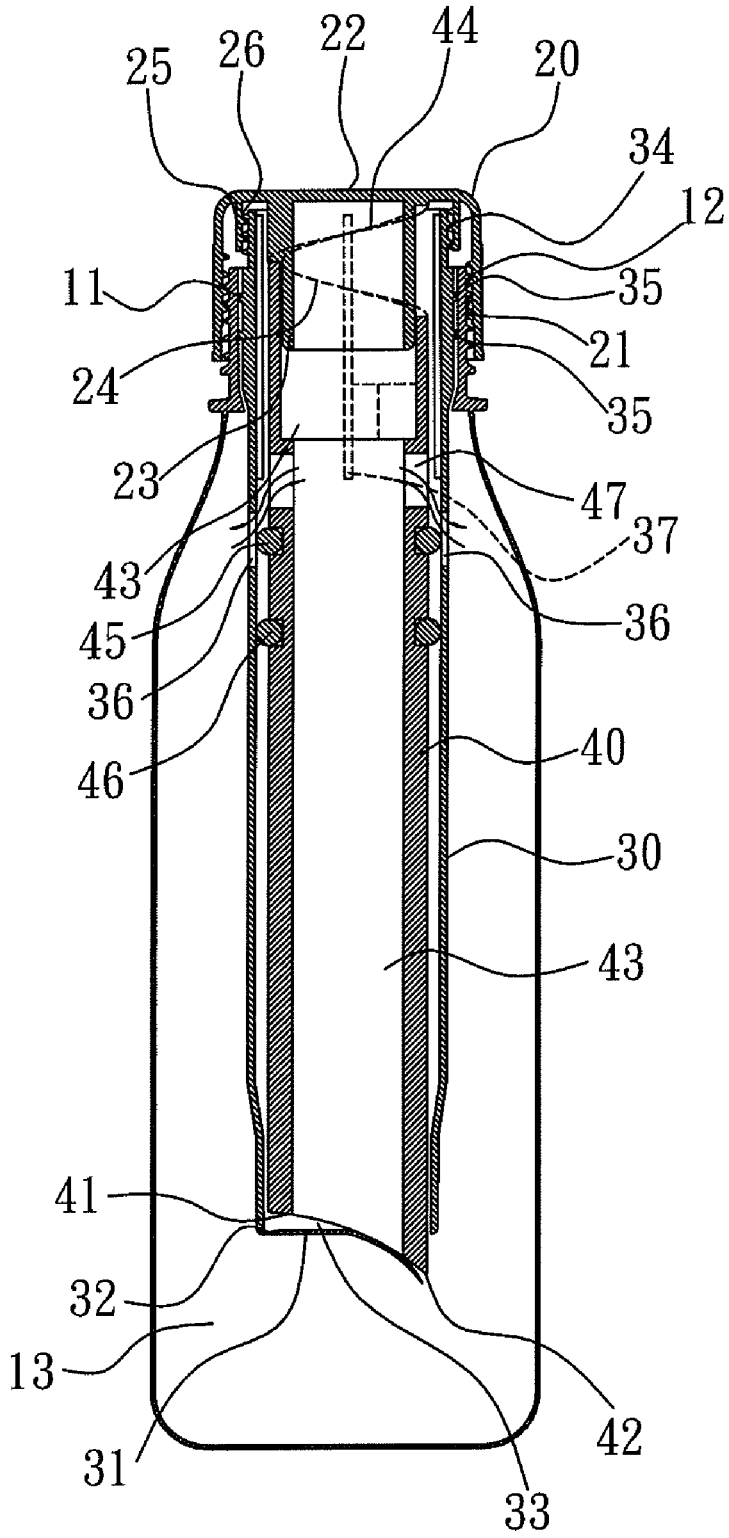
FIG. 7 is a schematic operational view of the beverage mixing device as shown in FIG. 4.
Figure 8:
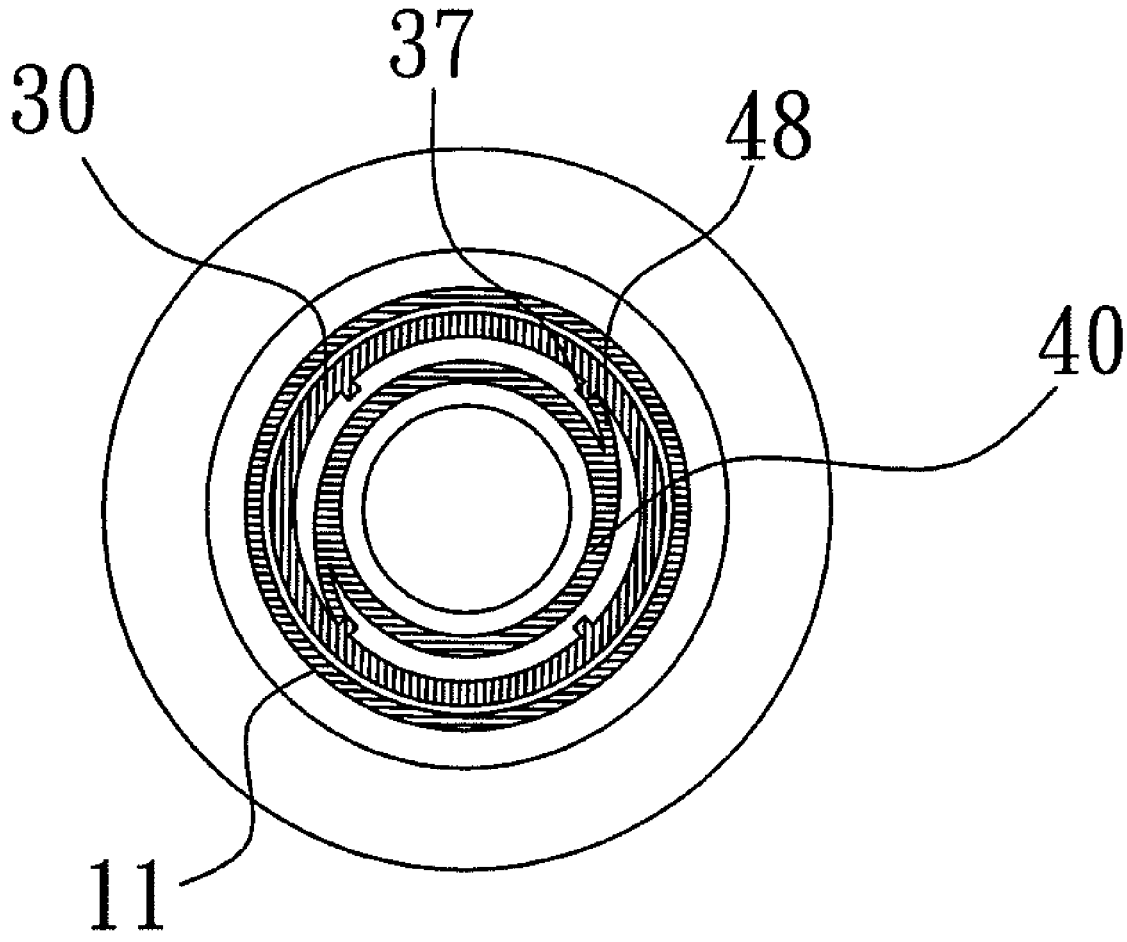
FIG. 8 is a top cross-sectional view of the beverage mixing device as shown in FIG. 7.

In operation, referring to FIGS. 4-10 with reference to FIGS. 1-3, the helical drive portion 24 of the top cap 20 initially abuts the helical driven portion 44 of the sliding member 40 as shown in FIGS. 4 and 6. Thus, when the inner thread 21 of the top cap 20 is unscrewed from the outer thread 12 of the primary container 10 to unlock and remove the top cap 20 from the primary container 10, the inner threaded portion 26 of the top cap 20 is unscrewed from the outer threaded portion 34 of the secondary container 30, and the helical drive portion 24 of the top cap 20 is rotated to press the helical driven portion 44 of the sliding member 40 downward so that the sliding member 40 is pushed to move downward as shown in FIG. 7, and the cutting blade 41 of the sliding member 40 is moved to penetrate and break the diaphragm 31 as shown in FIG. 9 so as to connect the secondary container 30 and the sliding member 40 to the primary container 10. In such a manner, the second beverage in the receiving chamber 33 of the secondary container 30 and the receiving space 43 of the sliding member 40 is mixed with the first beverage in the compartment 13 of the primary container 10 so as to form a mixed beverage.

As shown in FIG. 4, the conducting holes 36 of the secondary container 30 are sealed by the upper O-ring 45 and the lower O-ring 46 to prevent the first beverage in the compartment 13 of the primary container 10 from flowing through the conducting holes 36 of the secondary container 30 into the receiving chamber 33 of the secondary container 30 and the receiving space 43 of the sliding member 40 so as to prevent the first beverage from mixing with the second beverage due to vibration or shock during packaging or transportation before the diaphragm 31 is broken. At this time, an annular gap 49 is defined between the sliding member 40 and the secondary container 30.

As shown in FIG. 9, after the sliding member 40 is moved downward to break the diaphragm 31, the upper O-ring 45 is located under the conducting holes 36 of the secondary container 30, and the connecting holes 47 of the sliding member 40 are aligned with and connected to the conducting holes 36 of the secondary container 30, so that the first beverage in the compartment 13 of the primary container 10 can flow through the conducting holes 36 of the secondary container 30 and the connecting holes 47 of the sliding member 40 into the receiving space 43 of the sliding member 40 to mix with the second beverage in the receiving space 43 of the sliding member 40.

As shown in FIG. 1, the cutting blade 41*a* and pointed portion 42*a* of the sliding member 40*a* have different shapes.

Figure 12:
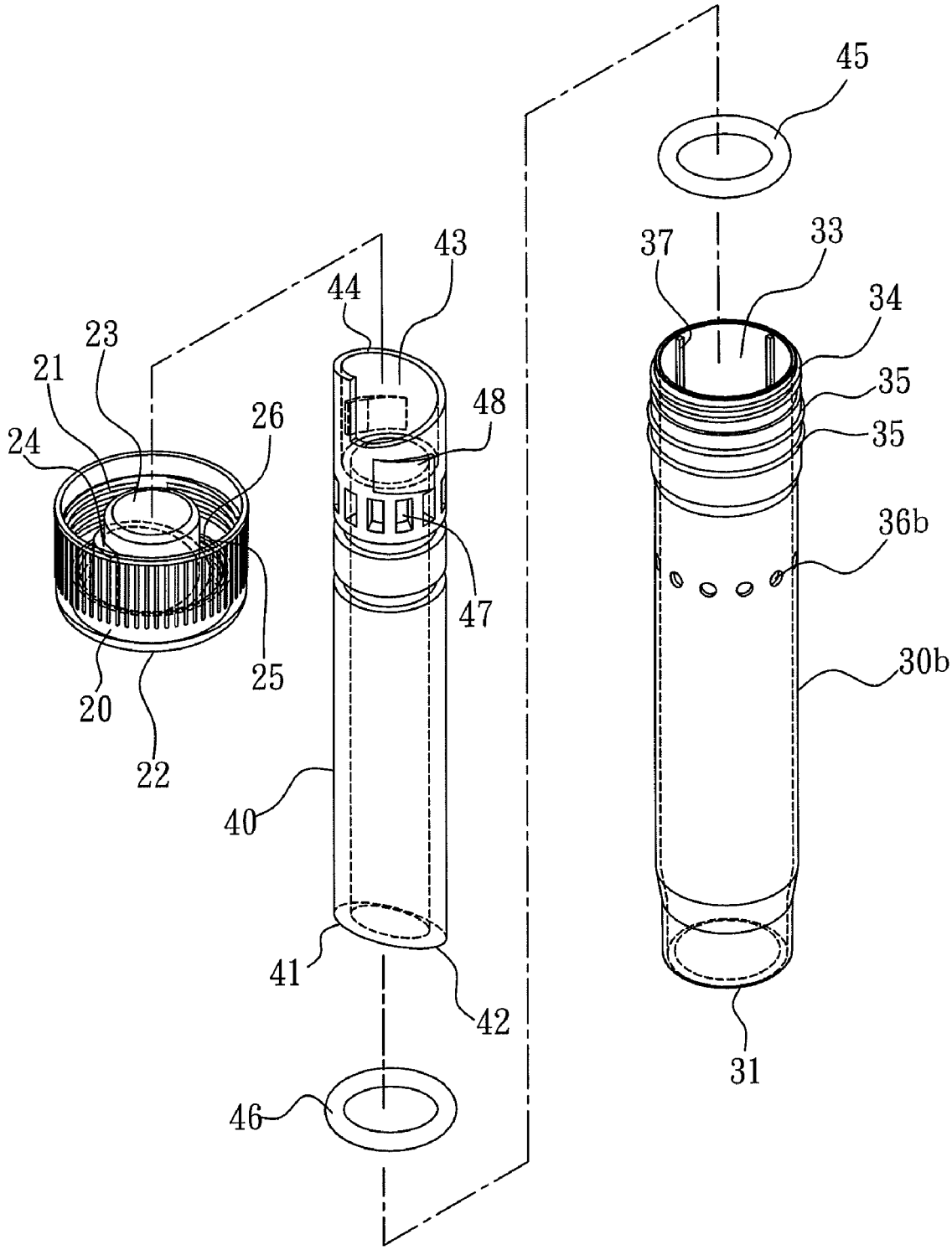
FIG. 12 is a partially exploded perspective view of a beverage mixing device in accordance with another preferred embodiment of the present invention.

As shown in FIG. 12, each of the conducting holes 36*b* of the secondary container 30*b* has a different shape.

Figure 13:
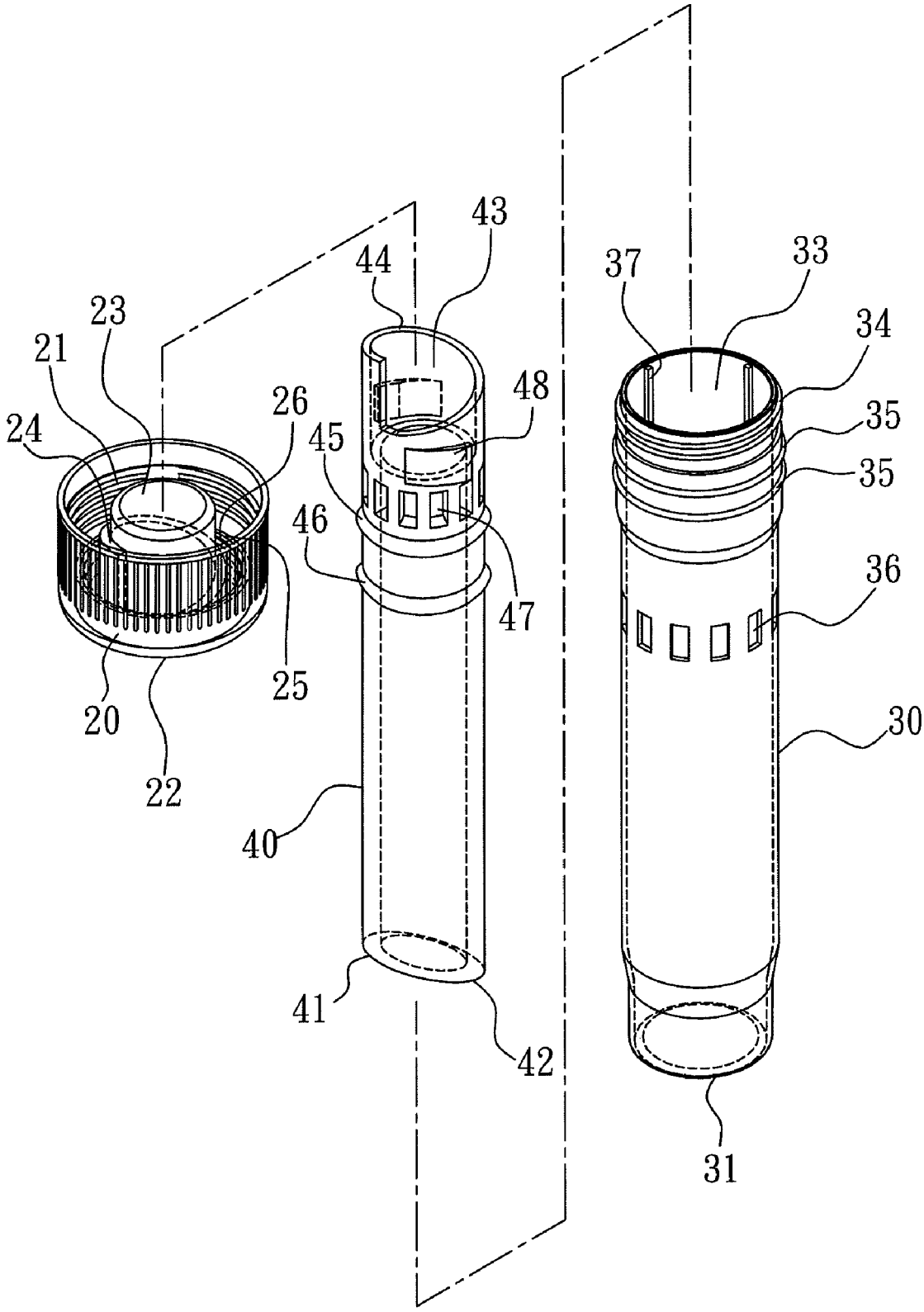
FIG. 13 is a partially exploded perspective view of a beverage mixing device in accordance with another preferred embodiment of the present invention.

As shown in FIG. 13, the sliding member 40 is integrally formed with the upper O-ring 45 and the lower O-ring 46.

Accordingly, the top cap 20, the secondary container 30 and the sliding member 40 are modularized and assembled previously so as to decrease the cost of fabrication of the beverage mixing device. In addition, the combination of the top cap 20, the secondary container 30 and the sliding member 40 can be directly mounted on the primary container 10 easily and quickly to facilitate assembly of the beverage mixing device. Further, a user only needs to rotate the top cap 20 in the counterclockwise direction to remove the top cap 20 from the primary container 10 and to break the diaphragm 31 so as to mix the first beverage and the second beverage simultaneously, thereby facilitating the user operating the beverage mixing device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A beverage mixing device, comprising:

a primary container;

a secondary container mounted in the primary container;

a diaphragm removably mounted on a lower end of the secondary container to seal the lower end of the secondary container and located between the secondary container and the primary container;

a sliding member movably mounted in the secondary container and having a lower end provided with a cutting blade that is movable relative to the secondary container to penetrate the diaphragm so as to connect the secondary container to the primary container and an upper end provided with a helical driven portion;

a top cap removably mounted on the primary container and having an inner portion provided with a helical drive portion abutting the helical driven portion of the sliding member to push the helical driven portion of the sliding member toward the diaphragm by rotation of the top cap relative to the sliding member.

2. The beverage mixing device of claim 1, wherein the primary container has an inner portion provided with a compartment;

the primary container has an upper end provided with a reduced mouth connected to the compartment;

the mouth of the primary container has an outer wall provided with an outer thread;

the top cap has an inner wall provided with an inner thread screwed onto the outer thread of the primary container to lock the top cap onto the primary container;

the secondary container has an outer wall provided with an outer threaded portion;

the top cap is provided with a mounting sleeve mounted on the secondary container;

the mounting sleeve of the top cap has an inner wall provided with an inner threaded portion screwed onto the outer threaded portion of the secondary container.

3. The beverage mixing device of claim 2, wherein the secondary container has an outer wall provided with two sealing rings closely fit in the mouth of the primary container.

4. The beverage mixing device of claim 2, wherein the secondary container has an inner portion provided with a receiving chamber;

the secondary container has a peripheral wall provided with a plurality of conducting holes each connected to the receiving chamber;

the beverage mixing device further comprises:

an upper O-ring biased between the sliding member and the secondary container and located above the conducting holes of the secondary container to seal the conducting holes of the secondary container;

a lower O-ring biased between the sliding member and the secondary container and located under the conducting holes of the secondary container to seal the conducting holes of the secondary container.

5. The beverage mixing device of claim 4, wherein the sliding member has an inner portion provided with a receiving space connected to the receiving chamber of the secondary container;

the sliding member has a peripheral wall provided with a plurality of connecting holes connected to the receiving space and located above the upper O-ring;

the connecting holes of the sliding member are aligned with and connected to the conducting holes of the secondary container when the cutting blade of the sliding member is moved to penetrate the diaphragm.

6. The beverage mixing device of claim 1, wherein the diaphragm has a peripheral wall provided with an annular tapered breakable portion connected with the lower end of the secondary container.

7. The beverage mixing device of claim 6, wherein the cutting blade of the sliding member is located above the diaphragm;

the cutting blade of the sliding member has a tapered shape and has a bottom provided with a protruding pointed portion that is movable to abut the breakable portion of the secondary container.

8. The beverage mixing device of claim 1, wherein the secondary container has an inner wall provided with a plurality of axially extending limit rails;

the sliding member has an outer wall provided with a plurality of limit blocks each abutting a respective one of the limit rails of the secondary container;

the sliding member is limited to move axially relative to the secondary container when the helical driven portion of the sliding member is pressed by the helical drive portion of the top cap;

the limit blocks of the sliding member are limited by the limit rails of the secondary container so that when the top cap is rotated, the sliding member will not driven by the top cap to rotate relative to the secondary container.

9. The beverage mixing device of claim 5, wherein the top cap has a central portion provided with a hollow plug insert into an upper end of the receiving space of the sliding member;

the helical drive portion of the top cap surrounds a periphery of the plug.

10. The beverage mixing device of claim 2, wherein the helical drive portion of the top cap is co-axial with and has a rotation direction opposite to that of the inner thread.

11. The beverage mixing device of claim 2, wherein the mounting sleeve of the top cap is co-axial with and located between the helical drive portion and the inner thread.

12. The beverage mixing device of claim 2, wherein the inner threaded portion and the inner thread of the top cap have the same thread pitch and the same rotation direction.

13. The beverage mixing device of claim 2, wherein the top cap has a top provided with a covering plate to seal the mouth of the primary container.

14. The beverage mixing device of claim 2, wherein the secondary container is inserted through the mouth of the primary container and is positioned in the primary container.

15. The beverage mixing device of claim 4, wherein the diaphragm is located at a bottom of the receiving chamber of the secondary container.

16. The beverage mixing device of claim 1, wherein the secondary container has a tubular shape;

the sliding member has a tubular shape.

17. The beverage mixing device of claim 2, wherein the outer threaded portion of the secondary container is located at an upper end of the secondary container.

18. The beverage mixing device of claim 5, wherein the receiving chamber of the secondary container is connected to the compartment of the primary container when the diaphragm is removed from the lower end of the secondary container.

the receiving space of the sliding member is connected to the compartment of the primary container when the diaphragm is removed from the lower end of the secondary container.

* * * * *